United States Patent [19]

Hyre et al.

[11] 4,054,034

[45] Oct. 18, 1977

[54] METHOD FOR CASTING CONCRETE TANKS IN WATER

[76] Inventors: Robert Warren Hyre, 4056 Brookfield Circle, East Ridge, Tenn. 37412; Hal Coburn Shook, Rte. No. 1, Box No. 114, Kensington, Ga. 30727

[21] Appl. No.: 701,676

[22] Filed: July 1, 1976

[51] Int. Cl.[2] ..... E02D 23/00

[52] U.S. Cl. ..... 61/86; 61/96; 61/100; 61/101

[58] Field of Search ..... 61/86, 87, 100, 97, 61/98, 34, 50, 41, 96; 264/34, 33, 290; 249/1, 10, 20, 17; 425/63

[56] References Cited

U.S. PATENT DOCUMENTS

| | | | |
|---|---|---|---|
| 1,758,606 | 5/1930 | Jacobs | 61/100 |
| 3,097,493 | 7/1963 | Blankenvoort | 61/34 X |
| 3,249,664 | 5/1966 | Georgii | 61/100 X |
| 3,464,212 | 9/1969 | Yamagata et al. | 61/96 |
| 3,499,292 | 3/1970 | Tavares | 61/100 |
| 3,893,304 | 7/1975 | Pochitaloff-Huvale | 61/100 |

FOREIGN PATENT DOCUMENTS

| | | | |
|---|---|---|---|
| 513,677 | 11/1921 | France | 61/86 |

*Primary Examiner*—Jacob Shapiro
*Attorney, Agent, or Firm*—J. Harold Kilcoyne

[57] ABSTRACT

Method of and apparatus for forming (casting) closed-ended hollow tanks of preferably circular or modified circular section and of diameter and height (length) ranging from small up to one hundred feet in diameter, a thousand feet in length and weighing one hundred million pounds, such as are suitable for under polar-ice transport and thereafter storage of petroleum, and for other uses as well. Forming and casting of such tanks is achieved preferably by slip-forming walls of concrete tanks (although conventional concrete forming and casting procedures and apparatus may also be employed), in ocean-depth water in which the tank is progressively submerged as forming and casting proceeds. The apparatus for carrying out the aforesaid method comprises a floating barge assembly comprising two spaced-apart trussed-together barges and a submersible casting barge disposed in the space between said spaced-apart barges on which latter a slab of desired configuration providing the closed bottom end of the tank is first cast. Towers of substantial height are provided on the mutually facing edges of said spaced-apart barges, atop each of which are mounted sheaves over which steel cables are trained, by which the casting barge and the tank as it is progressively formed and cast are suspended in such manner that both casting barge and the progressively formed and cast tank are free to swing with a pendulum action, it being explained however that the suspending cables support but a small yet sufficient amount of the total weight involved to maintain the pendulum action. The bulk of the weight of the concrete tank is supported first by the buoyancy of the casting barge and later by the buoyancy of the tank itself as it is progressively cast and lowered into the water. As forming of the tank proceeds, the steel cables are alternately released and reset to lower the tank and casting barge into the water while maintaining the upper end of the tank at a relatively constant elevation above water level, as by admitting water or other suitable ballast to the tank interior in amount counteracting the buoyancy of the tank upon the latter becoming greater than its weight and that of the casting barge, etc. . . Upon the tank being formed and cast to a particular length (depth), the submerged casting barge may be floated away from same, such without in any way interfering with further forming and casting of the tank should such be desired.

10 Claims, 11 Drawing Figures

FIG. 1
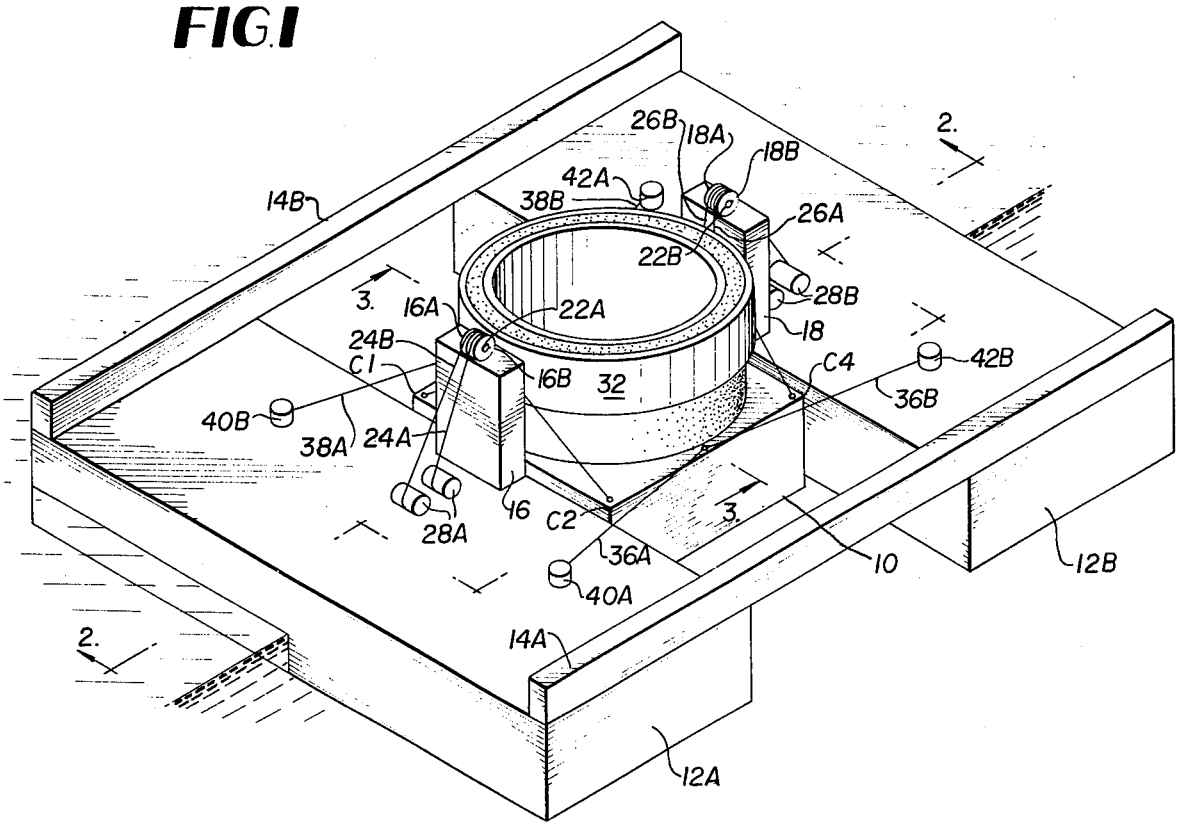
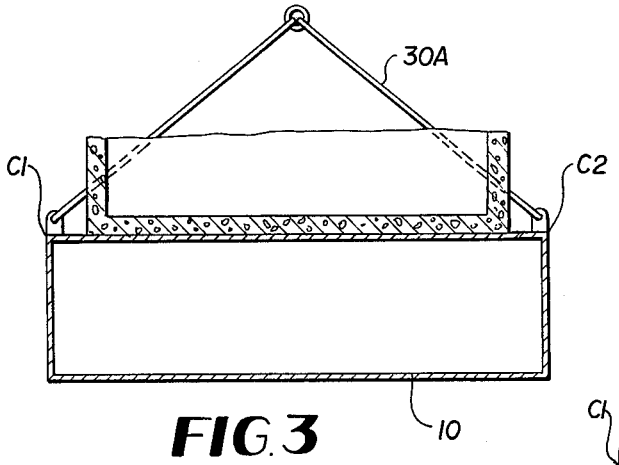
FIG. 3
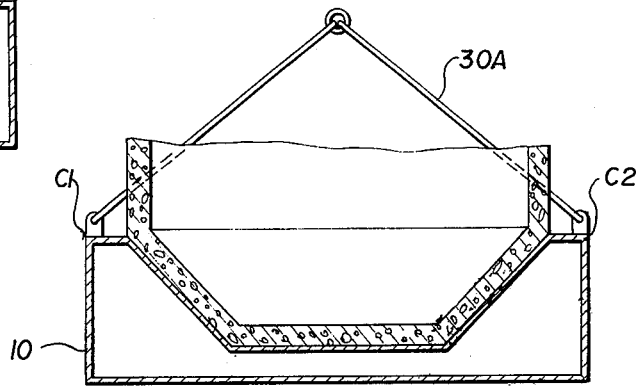
FIG. 4

METHOD FOR CASTING CONCRETE TANKS IN WATER

THE INVENTION

The present invention relates to a method of and apparatus for forming closed-ended elongate hollow tanks of diameter, length and wall strength rendering the tanks suitable for transporting petroleum products from Alaska's arctic north slope under the polar ice-cap under tow from a submarine, for example, for underwater petroleum storage purposes and/or for shoreline docks, floating piers, coffer dams, etc., at the same time being used for oil or liquid storage.

BACKGROUND OF THE INVENTION

It is of course well known to form elongated hollow bodies of considerable size of concrete for use as caissons, tunnel sections, etc . . . More recently, the prior patents record suggestions for forming closed-ended tanks designed to transport under tow and/or to store under water, petroleum or other lighter-than-water fluids, examples for such patents being Georgii U.S. Pat. No. 3,249,664 dated May 3, 1966, and Shurtleff U.S. Pat. No. 3,435,793 dated Apr. 1, 1969. However, such patented suggestions in the light of present-day technology appear to be visionary only and to constitute but superficial and impractical approaches to the problem, rather than teaching methods and/or apparatus which in fact advance the particular art.

OBJECTS OF THE INVENTION

A prinicpal object of the present invention is the provision of a practical method of and effective, relatively simple, proven apparatus implmenting said method for forming closed-ended hollow tanks of great size in ocean-depth water subject to wave action on a casting barge, characterized in that the tank and casting barge, as the tank is being formed, are progressively submerged and are purposely permitted a pendulum action, i.e., they are so suspended by cables trained over sheaves (or other suitable means) disposed atop paired towers of substantial height that they may swing with a pendulum action, whereby forming of the tank may proceed in deep ocean water regardless of wave or current action of the water.

Other objects will become apparent from the following more detailed description of the invention, taken with the accompanying illustrative drawing figures wherein:

FIG. 1 is a perspective view generally illustrative of a barge assembly and associated equipment employed in forming closed-ended hollow tanks of large diameter and great length, according to the invention;

FIGS. 3 and 4 are transverse sections taken on the center line of the casting barge (and the yoke suspension thereof) on which the bottom-end slab of the tank is formed and which further illustrate variant end-slab configurations;

Figure 2:
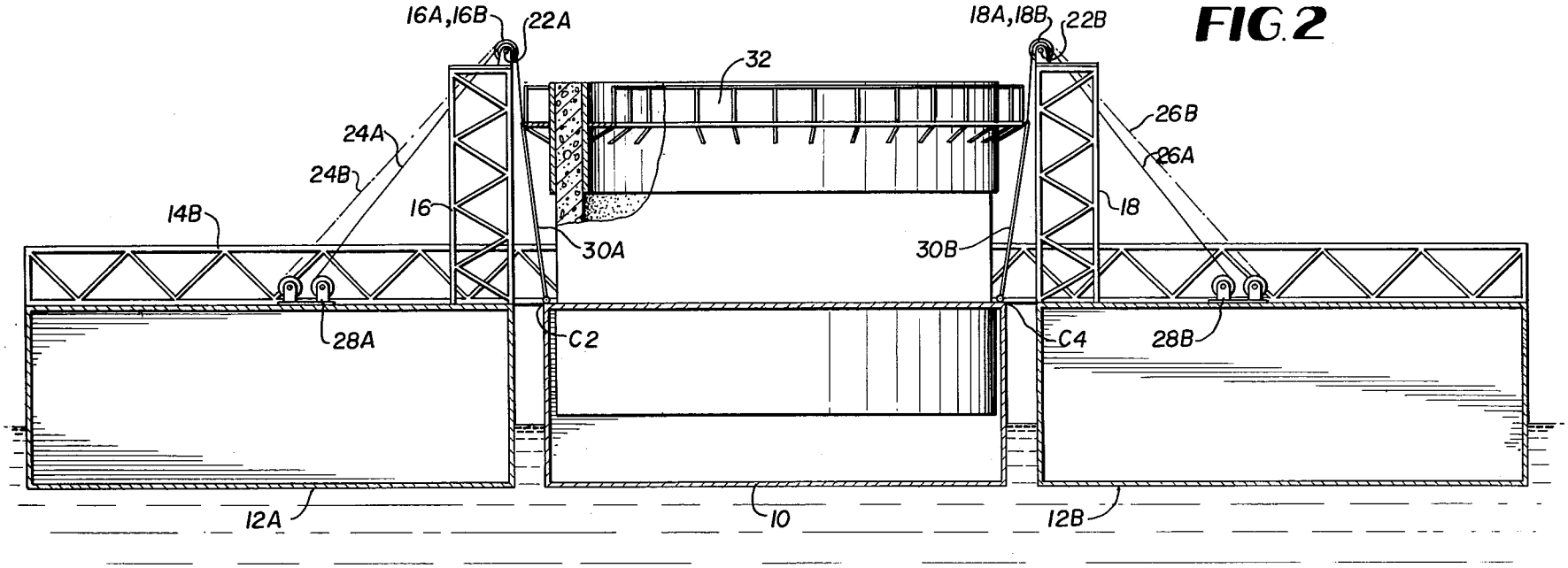
FIG. 2 is a side elevation, largely in section, of said barge assembly and associated equipment shown in FIG. 1.

Referring now to the aforesaid drawing figures in detail which, as hereinbefore stated, are illustrative of preferred apparatus of the invention employed to form tanks by casting same from concrete to the form of hollow, elongate closed-ended bodies in ocean-depth water, in sizes ranging from small to tanks of enormous size, reference numeral 10 designates a so-called casting barge floating independently of but within the space between two substantially larger barges 12A, 12B which are fixedly secured in spaced-apart relation by trusswork 14A, 14B whereby they react as a unitary barge.

Mounted symmetrically on or near the transverse center axis X-X of the trussed-together barges 12A, 12B and positioned near the mutually facing edges thereof are towers 16, 18, the minimum height of which according to the invention is sufficient to produce the adequate pendulum effect, as when cables are (partially) supporting the casting barge 10 and later the tank being cast thereon. Atop the aforesaid towers 16, 18 are mounted pairs of sheaves 16A, 16B and 18A, 18B, respectively, the sheaves of the pairs being turnable independently of one another on common axles or shafts 22A, 22B, and over the sheaves of the pairs thereof are trained steel cables 24A, 24B and 26A, 26B, respectively, of which one end portion of cable 24A extends relatively away from its tower 16 to and has its end affixed to one of two independently powered drums of a dual controlled winch 28A mounted on barge 12A, whereas its other or inner-end length portion extends downwardly from its sheave 16A for a short distance along the inner side of its tower 16 and terminates in an end which is affixed at a point near and just below the top of the tower 16 to a yoke 30A. By reference to FIGS. 3 and 4, it will be seen that said yoke has its ends attached to the two corners $C_1$, $C_2$ on the one side of the independently floating casting barge 10 which is adjacent said tower 16.

The other steel cable 26A of said cable pairs is trained over one of the pair of sheaves 18A, 18B mounted atop the companion tower 18, and extends to and is affixed at its one (outer) end to one of two independently powered drums of a winch 28B (corresponding to the aforesaid winch 28A) mounted on the barge 12B, with its other or inner end length portion extending downwardly a short distance from its sheave 18A along the companion tower 18 and is end-connected at a point just below the tower top to a yoke 30B (corresponding to the aforesaid yoke 30A) attached at its ends to the corners $C_3$, $C_4$ of the casting barge opposite the aforesaid corners $C_1$, $C_2$.

From the foregoing it will be appreciated that the invention provides a suspension form of support for the casting barge 10 operating on the pendulum principle, which is designed to and in fact enables casting to proceed in ocean-depth water subject to wave and/or current action. In this connection, it is desirable that the barge assembly 10, 12A, 12B be moored in said ocean-depth water with the ends of the barges facing into the wind so as to take advantage of the pendulum action as the barges react to, i.e. move up and down with, wave action.

The aforesaid towers 16, 18 also mount between them at a level well above the water line annular slip-casting (forming) means designated 32 of the required inner and outer diameters as is adapted progressively to form the tank side wall of concrete poured by procedures which may be the same or similar to those employed in progressively forming caissons, silo sections, etc. by known slip-form or slip-casting procedures.

The casting barge 10 will of course mount a tank bottom-end form on which the closed bottom end of the tank under construction will first be cast. As shown in FIGS. 3 and 4, said bottom-end slab may be configured to planar disc shape (FIG. 3), whereas alternately it may be configured as an end slab having a depressed central portion, or a convex configuration.

The steel cables 24B, 26B of the pairs thereof whose function has not been explained up to this point have their relatively outer ends attached each to the other of the independently powered drums of the aforementioned two winches 28A, 28B which may have built-in "slip" clutches or may be attached to barges 12A and 12B by cushioning devices such as air cylinders (not shown), such functioning to vertically stabilize the tank, and to diametrically opposite points on the hardened portion of the tank as has been cast, thereby to support it when it is desirable to lower the tank into the water as it is progressively cast, during which phase of the casting operation the cables 24A, 26A will be disconnected from the cable yokes 30A, 30B, to be later re-attached to the cast concrete tank above the points of attachment of cables 24B and 26B thereto. Thus the pairs of cables 24A, 26A and 24B, 26B alternately support a predetermined portion of the tank weight as it is progressively cast and lowered deeper and deeper into the water.

The casting barge 10 may have additional means attached thereto, such as cables 36A, 36B and 38A, 38B extending to winches 40A, 40B and 42A, 42B mounted on the barges 12A, 12B, to stabilize its movement, which stabilizing movement may be further cushioned by air cylinders (not shown) attached to or incorporated into said winches. Also if desired the cables 36A, 36B and 38A, and 38B, may be extended over the outside edges and continue downward and underneath barges 12A and 12B by means of sheaves (not shown) and attached at or near the bottom of the casting barge 10. When the tank is cast and submerged to a sufficient depth, it may no longer need the stabilizing means.

The casting barge 10 will have adequate surface size and depth as to safely support its own weight plus a predetermined share of the weight of the casting materials placed upon it, and is furthermore so constructed as to be water-tight when submerged, while at the same being provided with means enabling flooding of its interior with water and also with means for pumping out substantially all of said water admitted to its interior.

Briefly stated, the tank casting (or fabricating) operation is as follows: The bottom-end slab of concrete of predetermined thickness (with such reinforcing steel work as is considered necessary) and mechanical piping, inserts, etc., is cast to its desired shape on the barge 10. The slip-forming is then begun, casting the concrete at a predetermined rate, with a mixture of concrete which may or may not be of a special cement and admixtures, and with or without controlled curing temperature method as required as to cause the concrete to attain a predetermined cure and strength prior to the wall of the tank being submerged under water.

Figure 10:
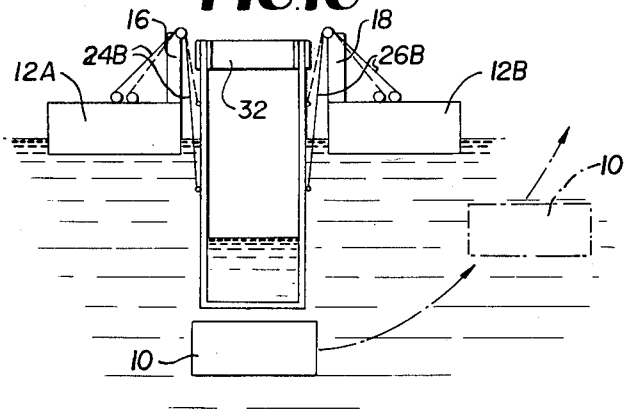
Figure 11:
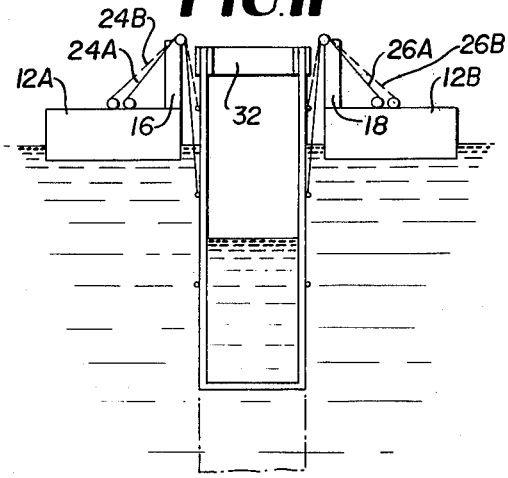

As the tank is cast to a desired predetermined height above the water, the casting barge 10 is partially submerged as desired by permitting a controlled amount of water to enter same. As the casting proceeds to the degree that the concrete tank itself will safely support its weight by its own buoyancy, less the weight that the two steel cables 24A, 26A and winches are supporting, the barge 10 may be completely flooded and thereupon may be floated out from under the concrete tank, as shown in FIG. 10, and brought to the surface for repeat use if such is desired.

During the stage of casting the tank prior to floating the casting barge 10 away therefrom as just described, the cables 24A, 26A maintain the tank and said barge supported with a pendulum effect as the latter is lowered deeper and deeper into the water. To maintain this pendulum effect during all stages of casting the tank, it is necessary to partially support the concrete tank with the steel cables 24A, 26A, or 24B, 26B (or other suitable means) from progressively higher and higher elevations as casting progresses and the tank is further submerged.

When submerged to such a depth that its buoyancy tends to cause the concrete tank to turn sideways, it is then necessary to add and continue to add adequate water, sand or any other ballast to the interior of the tank to hold it down in the water, thereby to offset the uplift forces caused by its buoyancy. Then and only then, are the cables 24A, 26A disconnected from the yokes 30A, 30B, and they are re-attached to the tank at progressively higher elevations.

Following further casting of the tank deeper and deeper in the water, cables 24A, 26A are then re-attached to the side of the tank also well above the water line, and cables 24B, 26B are released and more ballast is added to the tank interior. From the foregoing, it will be understood that the cables 24A, 26A and 24A, 26B are thus alternately attached to and released from the tank side wall until the tank is fully cast.

It will be understood however that from the very beginning throughout the entire casting operation the cables 24A, 26A, or 24B, 26B, must at all times support a sufficient amount of the total weight involved to maintain the pendulum action or effect. The total weight supported by the cables should be of such amount that if all cables were released from the tank it would quickly sink to the bottom of the ocean.

Figure 6:
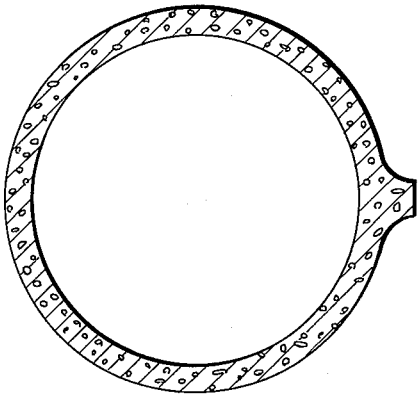
FIGS. 6 and 7 illustrate variant sections taken through the cast tank.
Figure 7:
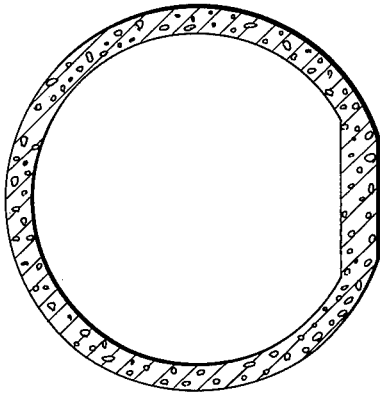
Figure 5:
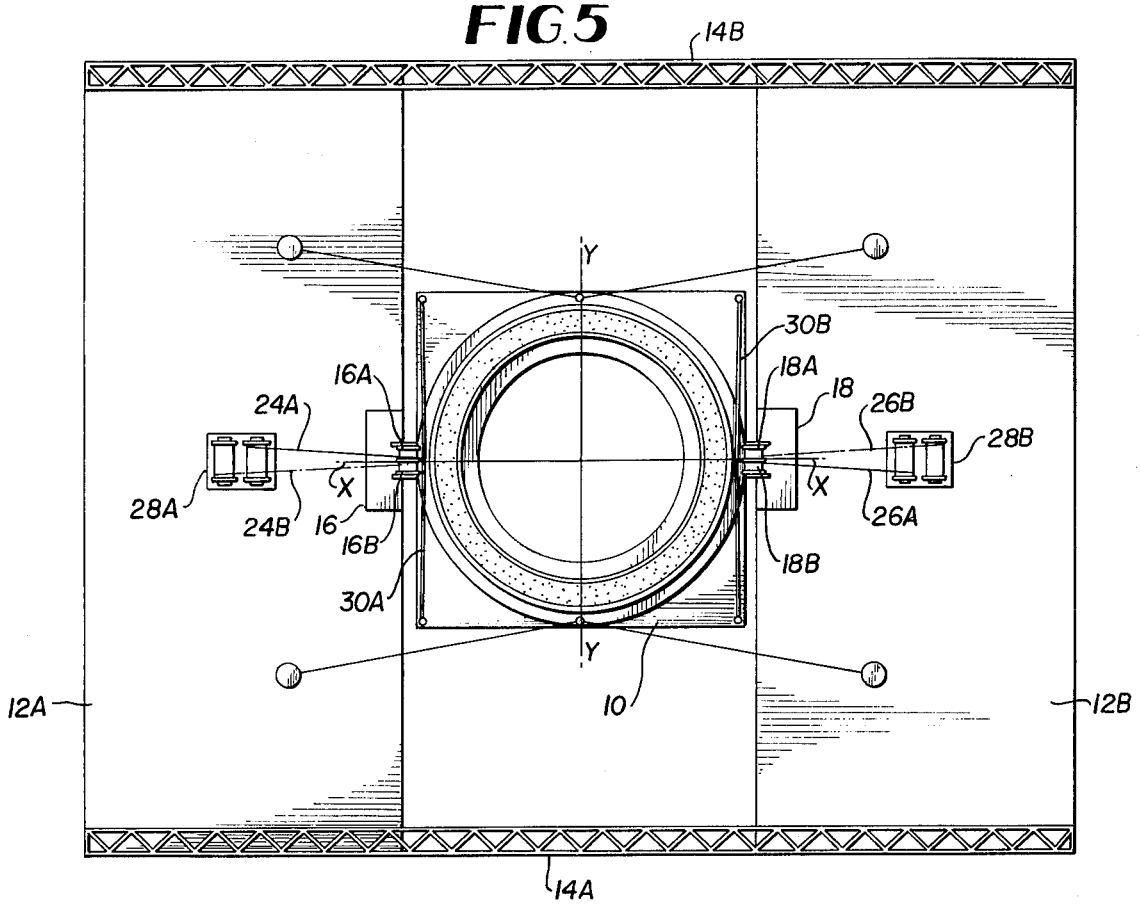
FIG. 5 is a plan view looking down on the barge assembly including the casting barge, the formed bottom-end slab, and the preferred means insuring pendulum action thereof regardless of wave or current motion.
Figure 8:
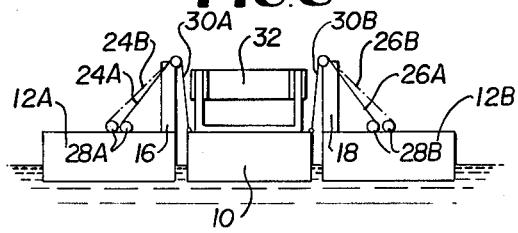
FIGS. 8, 9, 10, and 11 are views illustrating successive stages of casting a tank as herein proposed by apparatus according to the invention.
Figure 9:
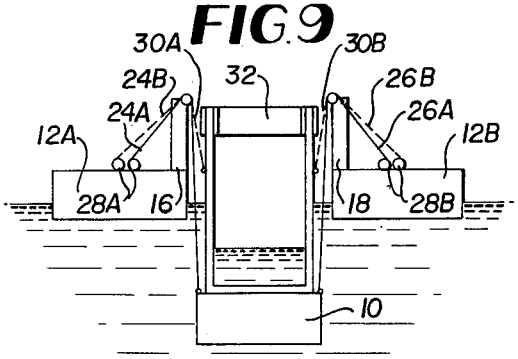

Finally, the open top of the tank is sealed off by pouring a concrete slab to extend across said open top and, when such has hardened, the water or other ballast on the inside of the tank is pumped out or otherwise removed and the tank is then permitted to float to the surface. To insure floating of the tank right side up at all times, a keel formation of any desired configuration, size and length may be cast to the one side of the tank ultimately to provide its under side as shown in FIG. 6. Alternately, said side of the tank may be formed with extra weight, as is shown in FIG. 7.

As an alternate to the steel cables supporting the casting barge and tank, other means such as hydraulic cylinders (not shown) mutually attached to the said towers at one end and other end to the yokes of the casting barge 10 and later to the sides of the tank, may be employed and cushioned by similar means as the winches described above.

While we have described our invention as applicable to casting a hollow generally circular-sectioned closed-ended tank of substantial length designed for transporting petroleum produced at various locations, including petroleum produced in fields such as Alaska's North slope under the polar ice cap, the invention is not limited to such use, but instead is equally applicable to forming square or rectangular tanks that may be, but not necessarily, cast with means for locking said tanks together, for forming docks along shore lines when submerged and for forming small islands, floating piers, bridges or coffer dam constructions, which at the same time may be used for oil or liquid storage.

Having disclosed our invention, we make the following claims therefor:

1. A method of forming and casting elongate, closed-ended hollow tanks in ocean-depth water comprising: casting a bottom-end closure slab and a short axial-length portion of the tank side-wall on a normally floatable and submersible tank end-closure form suspended by suspension means extending between diametrically spaced points thereof disposed on opposite sides of said form and laterally spaced-apart, substantially higher level points than said form points and which are subject to wave and/or current action, whereby said form, said formed end-closure and said formed partial length portion of the tank side-wall may together partake of pendular motion relative to said higher level points; permitting said form, formed end-closure and tank portion to submerge while continuing the tank side-wall forming and casting operation, to a depth such that the tank body has acquired substantial axial length and, during the course thereof, maintaining the tank body suspended as aforesaid and in a substantially vertical and stabilized position from said higher level points; causing said tank end-closure form to disengage and float away from said tank-end and the so-formed tank body; and continuing the tank side-wall forming and casting operations as may be necessary to the tank being cast to the desired axial length.

2. A method according to claim 1, and the additional step, upon the tank body being formed to a length such that its buoyancy tends to cause its normal suspended position in the water to change, of adding ballast to the tank interior.

3. A method according to claim 2, followed by the steps of deactivating the aforesaid form suspending means and establishing news points of tank suspension directly on the tank side wall above the water line.

4. Apparatus for forming and casting elongate closed-ended hollow tanks in ocean-depth water by progressively casting same from concrete or the like comprising: spaced-apart barges connected to react as a unitary barge and being together subject to wave and/or current action, a normally floatable but submergible casting barge floating independently of and being disposed in the space between said connected barges, said casting barge including means for forming a tank end-closure slab and a short length of tank side-wall upon concrete being poured thereonto, means for progressively forming and casting the side-wall of the tank body on said tank end-closure slab and in continuation of said short-length side-wall portion, means suspending said casting barge, said end-closure slab and such portion of the tank side-wall as has been cast thereon and hardened from transversely spaced high points provided on the mutually facing sides of said connected barges and in such manner that said casting barge, formed tank-end slab and tank side-wall may partake of pendular motion relative to said connected barges, means maintaining said pendular suspending means as forming of the tank proceeds, and means enabling the casting barge to free itself from the tank-end slab and tank body upon the latter being formed to a substantial axial length and thereupon to float itself to the surface.

5. Apparatus according to claim 4, wherein said high-level points comprise the tops of towers of substantial height erected on the facing edges of said connected barges.

6. Apparatus according to claim 5, wherein said suspension means includes sheaves mounted atop said towers, and cables trained over said sheaves and having their one ends extending relatively outwardly therefrom to powered drums mounted on said connected barges and their other ends connected at points disposed near but below said tower tops to yokes whose ends are in turn connected to the outer side corners of the casting barge.

7. Apparatus according to claim 4, wherein said suspension means includes hydraulic cylinders having their upper ends attached to the tops of said towers and their lower ends alternately attached to the tank as it is progressively cast and submerged in the water.

8. Apparatus according to claim 6 incorporating means for deactivating the aforesaid suspension means and for activating alternate suspension means directly connected to the concrete wall of the tank said latter means being effective only upon the tank being formed to a length such that its buoyancy causes or is likely to cause the tank to assume a non-upright position.

9. Apparatus according to claim 6 including stabilizing air cylinders mounted at predetermined locations on the connected barges at their one end and to the submergible barge by means of cables, and winch means for extending the length of the cables as the tank is progressively cast and submerged deeper into the water.

10. Apparatus according to claim 6 including means for vertically stabilizing the tank during motion of the barges due to wave action.

* * * * *